United States Patent [19]

Mott

[11] 4,037,625

[45] July 26, 1977

[54] SLIDING TUBE FLUIDIC CONTROLLER

[75] Inventor: Richard C. Mott, Harwood Heights, Ill.

[73] Assignee: Honeywell Inc., Minneapolis, Minn.

[21] Appl. No.: 621,183

[22] Filed: Oct. 9, 1975

[51] Int. Cl.[2] ..... F15D 1/02

[52] U.S. Cl. ..... 138/46; 138/26; 138/31; 138/40; 138/45; 137/608

[58] Field of Search ..... 138/26, 28, 31, 45, 138/45 A, 40, 46; 251/61.4, 61.5, 121; 137/46, 78, 608

[56] References Cited

U.S. PATENT DOCUMENTS

| | | | |
|---|---|---|---|
| 87,922 | 3/1869 | Franz | 138/46 X |
| 1,913,149 | 6/1933 | Atwater | 138/45 A |
| 2,030,251 | 2/1936 | Greener | 138/43 X |
| 2,617,478 | 11/1952 | Hildestad | 137/78 X |
| 2,911,034 | 11/1959 | Webb | 138/46 X |
| 3,150,686 | 9/1964 | Kachline | 138/43 X |
| 3,314,280 | 4/1967 | Burns et al. | 138/46 X |
| 3,433,245 | 3/1969 | Cymbalisty | 138/46 X |
| 3,511,470 | 5/1970 | Beckett et al. | 251/121 |
| 3,521,852 | 7/1970 | Gillis | 251/121 |
| 3,669,151 | 6/1972 | Fleming | 138/31 |
| 3,724,504 | 4/1973 | Matsui et al. | 138/46 |
| 3,938,551 | 2/1976 | Henkin | 251/61.4 X |
| 3,939,872 | 2/1976 | Wentworth | 138/31 |
| 3,946,760 | 3/1976 | Murakami et al. | 138/31 |

OTHER PUBLICATIONS

Hammond, C. H. et al., *Adjustable Pneumatic Resistor*, IBM Technical Disclosure Bulletin, vol. 12, May, 1970, p. 2329.

*Primary Examiner*—Richard E. Aegerter
*Assistant Examiner*—James E. Bryant, III
*Attorney, Agent, or Firm*—Trevor B. Joike

[57] ABSTRACT

A controller, wherein the throttling range may be changed without affecting the calibration point, comprises a restrictive passage between an outer tube and an inner tube, the outer tube having one end connected to a source of pressure and the other end connected to atmosphere for establishing a linear pressure gradient along said restrictive passage, the inner tube having an output port at one end and an orifice for connecting the linear pressure gradient to the output port, and a controller for positioning the orifice along said pressure gradient.

6 Claims, 8 Drawing Figures

SLIDING TUBE FLUIDIC CONTROLLER

BACKGROUND OF THE INVENTION

The invention relates to a fluidic controller which may be of the pneumatic type and which is especially suitable for permitting a change of throttling range without affecting the calibration point of the controller.

The controller includes an outer tube having one end connectable to a source of pressure and the other end connectable to a reference source of pressure, which may be atmosphere, and an inner tube having an output port at one end and an orifice. The inside diameter of the outer tube and the outside diameter of the inner tube are dimensioned to form a restrictive passage between the two ends of the outer tube and the orifice is positionable along this passage. When the first end of the outer tube is connected to an input pressure and the other end of the outer tube is connected to the reference pressure, a linear pressure gradient is developed along the restrictive passage. The orifice of the inner tube may then be positioned to pickoff any pressure along the pressure gradient and to connect that pressure to the output port of the inner tube.

Sliding tube arrangements having an inner tube and an outer tube are known in the prior art. The prior art, however, has failed to appreciate that the sliding tube arrangement may be used in a controller and has failed to recognize the advantages of such a controller.

SUMMARY OF THE INVENTION

Therefore, the sliding tube arrangement of the present invention is connected to a positioning device or means which may be operated by a sensor, e.g. a thermostat or humidity sensor. The resulting controller has the advantages that the throttling range may be changed without affecting the calibration point of the system, the throttling range is determined simply by the length of the outer tube and the controller is linear thus requiring no feedback. The controller has the further advantage that, unlike prior art controllers, the throttling range is not centered through zero output pressure. In another embodiment of the invention, plural outer tubes are provided, each outer tube having a distinct length determinative of the throttling range associated with each outer tube and there is provided a mechanism for allowing the inner tube to be changed from one outer tube to another, thereby altering the throttling range of the controller, without affecting the calibration point of the system.

DETAILED DESCRIPTION OF THE DRAWINGS

Figure 1:
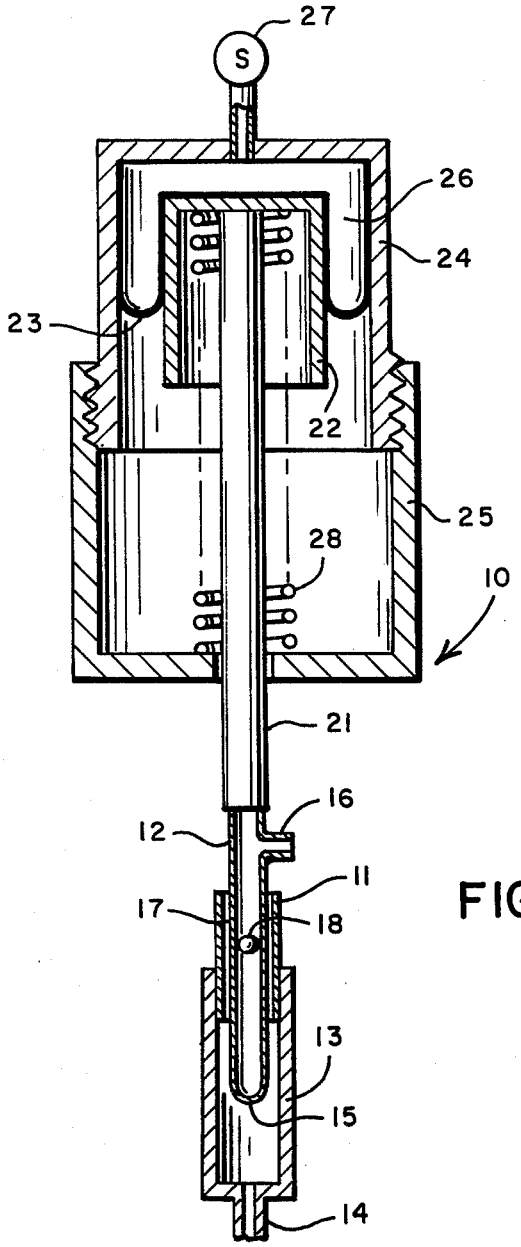
FIG. 1 shows the controller of the present invention.

In FIG. 1, the controller 10 comprises an outer tube 11 and an inner tube 12. At one end of the outer tube 11 is an input tube 13 having a port 14 for connecting a source of pressure to that end of the outer tube 11. The other end of the outer tube 11 is connected to a source of reference pressure which, in the case shown in FIG. 1, is atmosphere.

The first end 15 of the inner tube 12 may be substantially sealed and the other end of inner tube 12 has an output port 16 formed therein. The dimensions of the inner diameter of outer tube 11 and outer diameter of inner tube 12 are such as to form a restrictive passage 17 between the two tubes. An orifice 18 in the inner tube 12 may be positioned along the restrictive passage 17.

The restrictive passage 17 forms a linear pressure gradient along this restrictive passage and the pressure gradient is defined at one end by the pressure within the supply tube 13 and at the other end by atmosphere and by the length of the passage. Therefore, a linear pressure drop exists along the restrictive passage, and the orifice 18 of the sliding tube 12 may be positioned within the outer tub 11 to select any pressure along the pressure drop and communicate that pressure through the inner tube 12 to the output port 16. This structure is referred to as the sliding tube arrangement.

The inner tube 12 is connected to one end of a rod 21 at the other end of which is connected to a cup 22. The cup is secured to a diaphragm 23 which is suitably secured to a capsule 24. The capsule 24 is suitably threaded to mate with threads of capsule 25. A biasing spring 26 is located between the cup 22 and the capsule 25. The area 26 between the diaphragm 23 and the capsule 24 forms an input chamber which is connected to a sensing circuit 27 which may be comprised of a sensor such as a temperature sensor or a humidity sensor and associated circuitry. The setpoint for the controller may be adjusted by turning either the capsule 24 or the capsule 25 or may be established in the sensing circuit 27.

When the system such as that disclosed in the instant invention is initially installed, it must be calibrated and it is typically calibrated by ensuring that the load is controlled at a point corresponding to a particular controller output. For example, if the output port 16 of the inner tube 12 is connected to a valve which in turn controls the amount of temperature controlling medium supplied to a heat exchanger, the orifice 18 is positioned midway along the length of the outer tube 11 and the valve is arranged to open up half way at this position of the orifice 18. Once this system is calibrated, it is ready to begin operation. The inner tube 12 is then positioned by the rod 21 which moves in response to the pressure within the chamber 26. If it is desired, the rod 21 can alternatively be connected to move the outer tube 11. If the controller 10 is used in a temperature controlling mode and the sensor 27 senses a demand for increased heat, the pressure within chamber 26 increases which moves the inner tube 12 and the orifice 18 to a position where the orifice 18 will supply an increased pressure to the output 16 and to the load which will begin increasing the temperature of the controlled space.

Figure 2:
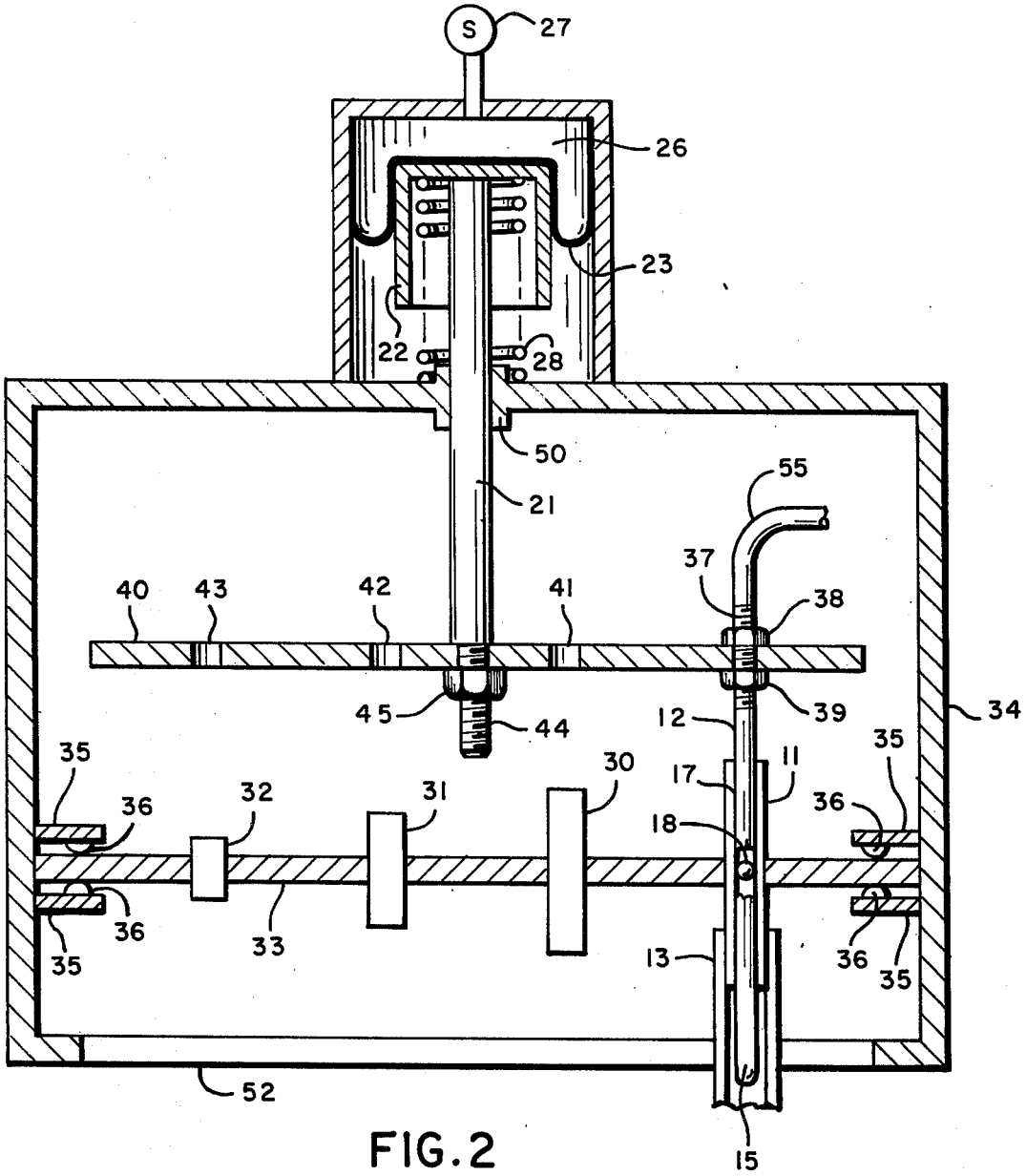
FIG. 2 shows a controller having a plurality of outer tubes and an inner tube which may be positioned in any of the outer tubes.

As aforementioned, the controller of FIG. 1 has certain unique advantages including, inter alia, the advantage that the throttling range of the system can be altered without affecting the calibration point. FIG. 2 shows a plural outer tube arrangement for allowing the throttling range of the controller to be changed without affecting the system calibration point. Similar elements of FIGS. 1 and 2 bear the same reference numerals.

In FIG. 2, a plurality of outer tubes 11, 30, 31 and 32 are supported by a support member 33 and each tube has a length for determining the throttling range of the controller. The support member 33 is held within the housing 34 by flange members 35 and retaining springs 36. The inner tube 12 is threaded at 37 to cooperate with nuts 38 and 39 for properly positioning the inner tube 12 to the desired calibration point within the outer tube 11 and securing the inner tube 12 to the inner tube support member 40. The support member 40 has additional holes 41, 42, and 43 therein for allowing the inner tube 12 to be positioned within the outer tubes 30, 31 and 32 respectively. The rod 21 has a threaded extension 44 for cooperating with a nut 45 to secure the inner tube support member 40 to the rod 21. The rod 21 extends through sleeve 50 of housing 34 and is connected to the inside end of cup 22.

Once the calibration point has been established for the controller shown in FIG. 2, the throttling range may be altered by loosening the nut 39 and withdrawing the inner tube 12 out of the inner tube 11 and repositioning the inner tube 12 within one of the other outer tubes 30–32 and resecuring the nut 39. The calibration point will thus be the same regardless of which of the outer tubes 30–32 is selected.

The throttling range of the controller is established by the length of the outer tube 11. When an outer tube is connected by the supply tube 13 to a source of pressure, a pressure gradient will be established along the restrictive passage 17 formed between the selected outer tube and the inner tube 12. The pressure gradient is defined at one end by the pressure applied to supply tube 13 and by atmosphere or the reference pressure at the other end and the length of the passage. When the tube 30 is chosen, for example, the pressure gradient between the outer tube 30 and inner tube 12 will again extend from the pressure supplied by input supply tube 13 and atmosphere but the pressure gradient will be greater. Thus, when the controller demands a change in the load as influenced by the sensor 27, the load will change a greater amount for each increment of travel of the inner tube 12.

The housing 34 has a slot 52 therein such that the supply tube 13 can be slipped off of the outer tube 11 and repositioned on one of the other tubes 30–32. An output tube 55 is fitted over the inner tube 12 to connect the pressure picked off by the orifice 18 to the load.

Figure 3:
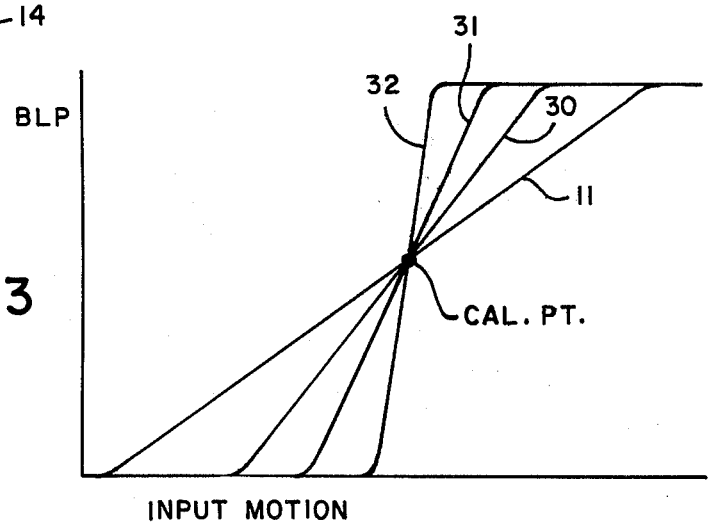
FIG. 3 is a graph showing that the throttling range of the controller, may be changed without affecting the calibration point.

The graph in FIG. 3 shows the response of the system to sensor input dependent upon the throttling range selected. The throttling range for the outer tube 11 results in less of a change of branch line pressure, i.e. output pressure, upon orifice motion than does the throttling range established by tubes 30–32. FIG. 3 also illustrates that the throttling ranges may be changed without affecting the calibration point of the controller.

Figure 4:
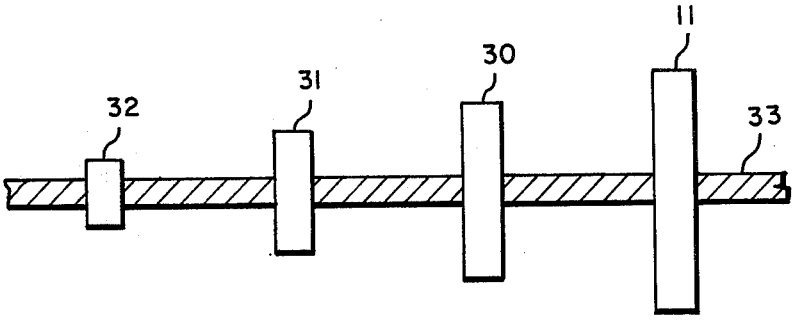
FIG. 4 shows a plurality of outer tubes each having a calibration point midway between the ends of the tubes.
Figure 5:
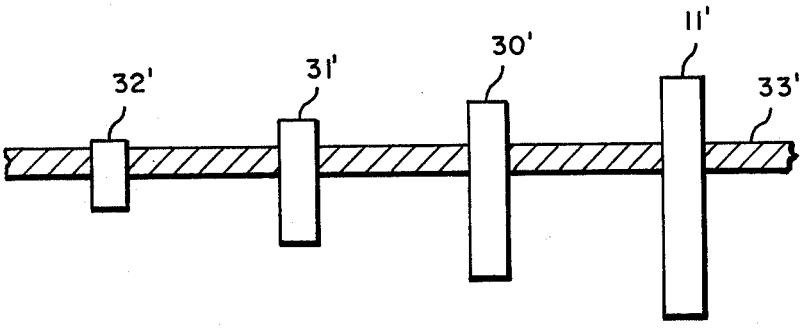
FIG. 5 shows a plurality of tubes each having a calibration point one-third the distance from the top of the tubes.

The outer tube arrangement shown in FIG. 4 is the same as that shown in FIG. 2. In this case, the tubes 11, 30, 31 and 32 are positioned on support member 33 such that the calibration point is midway between the ends of each tube. The outer tubes 11', 30', 31' and 32' shown in FIG. 5 are arranged on support member 33' to have a calibration point one-third of the way down from the top of each outer tube. Thus, the outer tube arrangement shown in FIG. 5 may be easily substituted for that shown in FIG. 2 and the system may be recalibrated whereby the inner tube 12 may thereafter be changed between the various outer tubes without affecting the calibration point of the controller. With the calibration of each tube at a predetermined distance between the ends of the outer tube, the throttling range may be changed without changing the calibration point.

Figure 6:
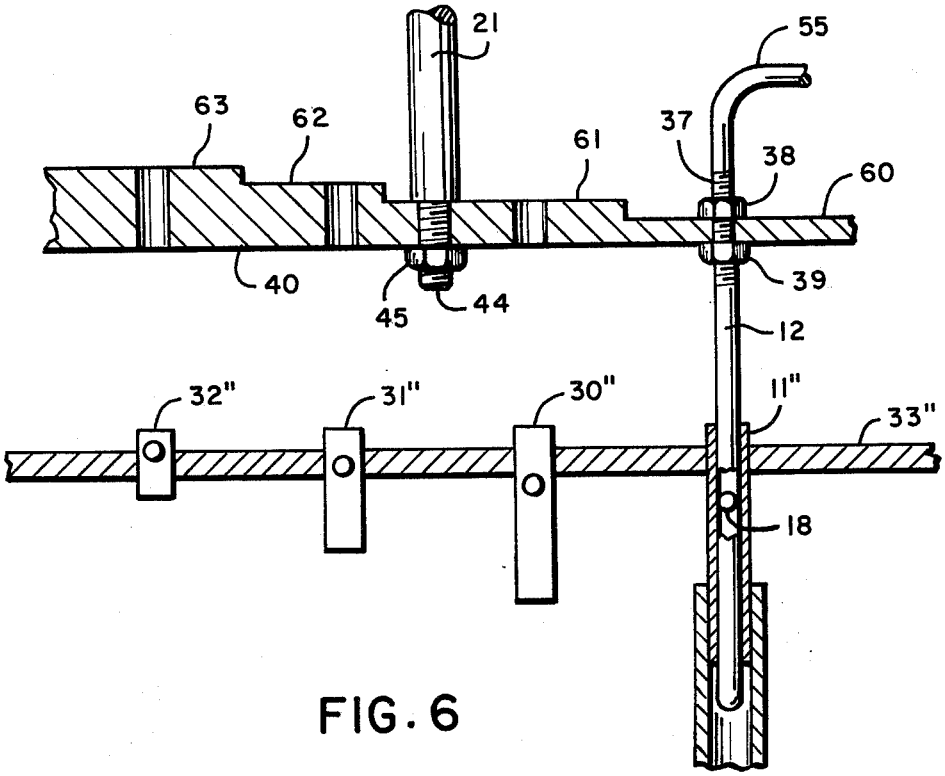
FIG. 6 shows another form of the controller.

The arrangement in FIG. 6 is another configuration for that shown in FIG. 5. Specifically, the outer tubes 11", 30", 31" and 32" each have a calibration point one-third of the way from the top of each tube. However, since the tops of all of the tubes are level, the inner tube support number 40" must be stepped at 60, 61, 62 and 63 to insure that the orifice 18 will be positioned one-third of the way down from the top of each of the tubes 11", 30", 31" and 32". The inner tube 12 can, therefore, be moved from tube to tube without affecting the calibration point of the controller.

Figure 7:
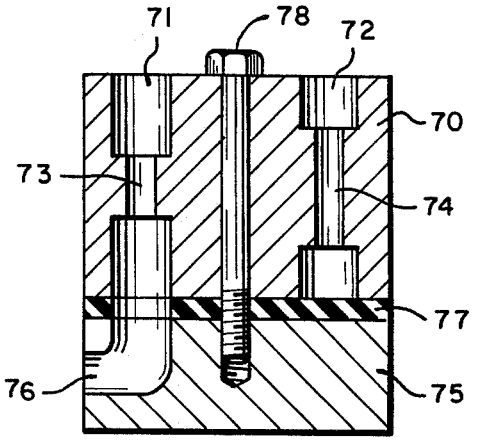
FIG. 7 shows a rotary construction for the outer tubes.
Figure 8:
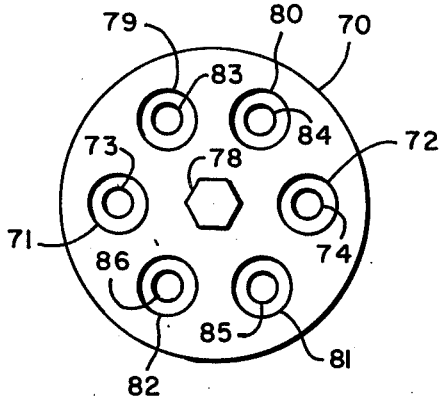
FIG. 8 is a top view of the outer tube structure of FIG. 7.

The device shown in FIGS. 7 and 8 is another form that the outer tube structure may take to allow a change in throttling range in the controller without affecting the calibration point. The support structure 70 has a plurality of openings 71 and 72 provided therein with restrictive openings 73 and 74 to form the outer tube arrangement. A lower manifold section 75 is provided having an inlet passage 76 for connecting the input pressure source to the various outer tube arrangements. A gasket 77 is provided to seal the support member 70 from the manifold 75 an to allow for the connection of the inlet passage 76 to the various outer tube arrangements. The support member 70, gasket 77 and manifold 75 are held together by a bolt 78. The top view shown in FIG. 8 shows the other holes 79, 80, 81 and 82 with corresponding outer tubes 83, 84, 85, and 86.

The embodiments of the invention in which an exclusive property or right is claimed are defined as follows:

1. A fluidic controller having at least two selectable throttling ranges each having a corresponding calibration point, said controller comprising:

an outer tube having a first end connectable to a source of pressure and a second end connectable to a source of reference pressure;

inner tube means extending within said outer tube for forming a restrictive passage capable of establishing a substantially linear pressure gradient therealong between said outer tube and said inner tube means, said inner tube means having a first end and a second end, said second end having an output port, said inner tube means further having an orifice for communicating said restrictive passage to said output port;

sensing means for sensing a condition;

positioning means responsive to said sensing means for positioning said orifice along said passage; and, throttling range changing means for changing the throttling range of said controller without affecting the calibration point.

2. The controller of claim 1 wherein said throttling range changing means comprises at least one additional outer tube, each outer tube having a predetermined length for determining a corresponding throttling range and each tube being arranged to have a corresponding calibration point whereby a change in throttling range may be effected without a change in calibration point.

3. The controller of claim 2 wherein said throttling range changing means comprises means for allowing the repositioning of said inner tube means from said outer tube to said additional outer tube without altering the calibration point of said controller.

4. The controller of claim 1 wherein said positioning means is connected to said inner tube means.

5. The controller of claim 4 wherein said throttling range changing means comprises at least one additional outer tube, each outer tube having a predetermined length for determining a corresponding throttling range and each tube being arranged to have a corresponding calibration point whereby a change in throttling range may be effected without a change in calibration point.

6. The controller of claim 5 wherein said throttling range changing means comprises means for allowing the repositioning of said inner tube means from said outer tube to said additional outer tube without altering the calibration point of said controller.

* * * * *